US006029617A

United States Patent [19]

Lambert et al.

[11] Patent Number: 6,029,617

[45] Date of Patent: Feb. 29, 2000

[54] MODULAR ROTARY DISCOID VALVE ASSEMBLY FOR ENGINES AND OTHER APPLICATIONS

[76] Inventors: Steven Lambert, 1122 Ontario St., Burbank, Calif. 91505; Michael Lambert, 2032 Highland Ave., Los Angeles, Calif. 90068

[21] Appl. No.: 09/236,774

[22] Filed: Jan. 26, 1999

Related U.S. Application Data

[63] Continuation-in-part of application No. 09/076,287, May 12, 1998, Pat. No. 5,911,203.

[51] Int. Cl.[7] ..... F01L 7/06

[52] U.S. Cl. ..... 123/80 D; 123/190.14

[58] Field of Search ..... 123/80 R, 80 BA, 123/80 D, 190.1, 190.4, 190.8, 190.14; 251/205, 208; 137/625.15, 625.21

[56] References Cited

U.S. PATENT DOCUMENTS

| | | | |
|---|---|---|---|
| 323,568 | 8/1885 | Doherty . | |
| 495,282 | 4/1893 | Vogel . | |
| 630,767 | 8/1899 | Beadle . | |
| 856,569 | 6/1907 | Catlin . | |
| 1,024,619 | 4/1912 | Coffin | 123/190.14 |
| 1,064,476 | 6/1913 | Haskell . | |
| 1,084,410 | 1/1914 | Drennon . | |
| 1,089,779 | 3/1914 | Morgan . | |
| 1,212,875 | 1/1917 | Anderson | 123/80 D |
| 1,247,156 | 11/1917 | Russell . | |
| 1,291,917 | 1/1919 | Kennedy . | |
| 1,547,253 | 7/1925 | McCarthy . | |
| 2,247,227 | 6/1941 | Findley . | |
| 2,459,973 | 1/1949 | Stevens . | |
| 3,822,682 | 7/1974 | Sherwood . | |
| 3,948,286 | 4/1976 | Dunbar et al. . | |
| 3,993,036 | 11/1976 | Tischler | 123/190.2 |
| 4,036,184 | 7/1977 | Guenther | 123/190.2 |
| 4,163,438 | 8/1979 | Guenther et al. | 123/190.2 |
| 4,286,500 | 9/1981 | Stevenson . | |
| 4,881,574 | 11/1989 | Olson et al. . | |
| 4,944,261 | 7/1990 | Coates . | |
| 4,953,527 | 9/1990 | Coates . | |

(List continued on next page.)

FOREIGN PATENT DOCUMENTS

| | | | |
|---|---|---|---|
| 162255 | 3/1904 | Germany . | |
| 33 38 637 A1 | 9/1985 | Germany . | |
| 3-253709 | 11/1991 | Japan | 123/80 D |

*Primary Examiner*—Erick R. Solis
*Attorney, Agent, or Firm*—Cesari and McKenna, LLP

[57] ABSTRACT

A modular rotary discoid valve assembly includes a housing for positioning on an engine of the piston and cylinder type. The housing includes an intake passage for conducting a working fluid to the cylinder and an exhaust passage for conducting the working fluid from the cylinder. The housing has an internal cavity which intercepts the intake and exhaust passages, which cavity contains a rotary valve member having a window whose size may vary with increasing distance from the disc axis and/or angular position on the member. The window is so positioned that when the member is rotated, it opens and closes the intake and exhaust passages in a periodic manner. The valve assembly also includes a throttle member mounted in the housing parallel to the rotary valve member. The throttle member has a hole which may be positioned opposite the intake passage. The throttle member is movable relative to the axis of the rotary valve member between a first position which places the hole in the shutter means opposite a first portion of the valve member and a second position which places that hole opposite a second portion of the valve member so that when the valve member is rotated, the open time of the intake passage can be controlled by the position of the throttle member. A plurality of similar valve assemblies can be positioned adjacent to one another and concatenated so that they all operate in unison to control the working fluid flow to and from all the cylinders of a multi-cylinder engine. The assembly is particularly suitable for converting an internal combustion engine so that it operates under steam power. Other applications for the assembly are also disclosed.

19 Claims, 5 Drawing Sheets

U.S. PATENT DOCUMENTS 4,976,232 12/1990 Coates .
4,989,558 2/1991 Coates .
4,989,576 2/1991 Coates .
5,109,814 5/1992 Coates ..... 123/190.14
5,251,591 10/1993 Corrin .
5,308,040 5/1994 Torres .
5,309,876 5/1994 Schiattino ..... 123/190.2
5,558,049 9/1996 Dubose .
5,572,967 11/1996 Donaldson, Jr. ..... 123/80 C
5,623,901 4/1997 Hartzell .
5,690,069 11/1997 Huwarts ..... 123/190.2
5,718,198 2/1998 Adamison et al. .

MODULAR ROTARY DISCOID VALVE ASSEMBLY FOR ENGINES AND OTHER APPLICATIONS

RELATED APPLICATION

This application is a continuation-in-part of Ser. No. 09/076,287, filed May 12, 1998 now U.S. Pat. No. 5,911,203.

BACKGROUND OF THE INVENTION

This invention relates to a modular rotary discoid valve assembly for controlling the flow of a working fluid to and from the cylinder of an engine or pump of the piston and cylinder type or to regulate fluid flow generally.

In an engine of the piston and cylinder type, it is necessary to charge each cylinder with a working fluid during the intake part of the engine cycle and to vent the fluid from the cylinder during the exhaust portion of each cycle.

In the case of an internal combustion engine, the working fluid injected into the cylinder is a fuel/air mixture and the fluid exhausted from the cylinder comprises the products of combustion of that fuel/air mixture. In the case of a uniflow steam engine, the working fluid is high pressure steam which is injected into the cylinder when the cylinder is at top dead center said steam being vented from the cylinder at the bottom of the piston stroke. Counterflow steam engines exhaust the steam through exhaust valves in the cylinder head at top dead center. In all of these engines, the flow of the working fluid to and from the engine cylinders is controlled by intake and exhaust valves which open and close at the appropriate times during each cycle of each cylinder of the engine. In conventional gasoline engines, the valves are usually spring-loaded reciprocating valves which are opened and closed by cams on a rotary cam shaft, the cam shaft being rotated by the engine's crank shaft. Such reciprocating valves require a relatively large number of moving parts such as return springs, lifters, etc. Those valves are also prone to excessive wear and usually cause appreciable noise and vibration during operation of the engine.

State of the art steam engines employ variable cut-off throttles. Older, less efficient and less responsive steam engines employ fixed cut-off throttles. Fixed cut-off engines position the throttle in a position similar to that of the carburetor in an internal combustion engine. In a fixed cut-off system, a manifold connects the throttle to the cylinders. When the intake valve closes, steam is left in the manifold. The steam in the manifold loses heat energy and pressure decreases. If the driver backs off the throttle completely, causing it to close, the other cylinders remove the remaining steam from the manifold, wasting it. When the throttle is re-opened, the manifold must be refilled with steam before the steam can enter the intake valves. Thus, leaving steam in the manifold during deceleration wastes energy.

In a variable cut-off system, the intake valves perform the throttle function. For the intake valves to meter the steam entering the cylinder, open valve time must be variable. In the past, this was accomplished by using two intake valves. Each valve was opened by a different cam. In order for steam to enter the cylinder, both valves had to be open at the same time. Such a multiple valve, multiple cam arrangement is complex and lacks precision.

To address such problems, it has been proposed to employ rotary valves to control the flow of the working fluid to and from the engine cylinders. For example, U.S. Pat. No. 4,944,261 discloses a spherical rotary valve assembly for an internal combustion engine. In accordance with that teaching, each engine cylinder requires two such assemblies, one to control the flow of the fuel/air mixture to the associated cylinder and the other valve to control the exhaust of the combustion products from that cylinder. Because the moving valve member of that valve assembly is a complicated 3-dimensional part, the assembly as a whole is difficult to manufacture and therefore relatively expensive. Bearing in mind that each engine may comprise 4, 6, 8 or more cylinders, each of which requires two such valve assemblies, the implementation of that patented construction adds materially to the overall cost of a typical engine.

In other conventional engines, complicated fuel injectors are used to inject the fuel into the engine cylinders at the appropriate times.

It would be advantageous, therefore, to be able to provide a simple, low cost valve assembly which can replace the reciprocating valves or injectors on a standard gasoline or diesel engine to enable that engine to run under steam power.

SUMMARY OF THE INVENTION

Accordingly, it is an object of the present invention to provide an improved rotary valve assembly for an engine of the piston and cylinder type.

Another object of the invention is to provide a modular rotary discoid valve assembly which can be retrofit to a conventional internal combustion engine to allow that engine to be operated under steam power.

A further object of the invention is to provide a modular rotary valve assembly of this type which can control the flow of the working fluid both to and from each engine cylinder.

Another object of the invention is to provide a rotary valve that eliminates the need for any camshaft, while enabling the control unit to automatically create the effect of a racing cam when acceleration and speed are desired or a miles per gallon (mpg) cam when mileage is the priority.

Another object of the invention is to provide such a valve assembly which can be made relatively inexpensively in quantity.

A further object of the invention is to provide rotary discoid valve assembly which can be installed on a conventional engine of the piston and cylinder type with a minimum amount of time and effort.

It is another object of the invention to provide such a valve assembly which has separate utility in a pump and as a fluid control device.

Other objects will, in part, be obvious and will, in part, appear hereinafter.

The invention accordingly comprises the features of construction, combination of elements and arrangement of parts which will be exemplified in the following detailed description, and the scope of the invention will be indicated in the claims.

Briefly, our modular rotary valve assembly may be used on an engine of the piston and cylinder type to control the flow of working fluid to and from a cylinder of that engine. If the engine has more than one cylinder, a number of such assemblies corresponding to the number of cylinders in the particular engine may be concatenated and driven in unison by the engine's crank shaft. The valve assembly has particular application to the conversion of an internal combustion engine to an engine which uses steam as the working fluid to drive the pistons. However, as we shall see, the assembly may also be used to control the flow of fluid to and from a pump and to regulate fluid flow generally.

The valve assembly comprises a housing which may be mounted to the top of a standard engine block. The housing is formed with a narrow cavity shaped to snugly receive a rotary valve member, e.g., in the form of a disc. The valve member has an axle or shaft which is journalled in the housing so that when the module is installed on the engine block, the axle may be coupled for rotation with the engine crank shaft. Also formed in the housing are an intake passage and an exhaust passage, each such passage being interrupted by the housing cavity containing the rotary valve member. The intake passage extends from a port at the top or a side of the housing to a port at the underside of the housing. The exhaust passage extends from a port at the underside of the housing to a port at the top or a side of the housing. The two ports at the underside of housing are spaced apart and open into the top of an engine cylinder when that module is mounted to the engine block.

The port at the entrance end of the intake passage is adapted to be connected to a source of working fluid such as high pressure steam and the port at the exit end of the exhaust passage is adapted to be connected to a suitable exhaust manifold.

As noted previously, the intake and exhaust passages are interrupted by the cavity in the manifold housing. Consequently, when the valve member is mounted for rotary motion within that cavity, it intercepts the intake and exhaust passages.

In accordance with the invention, the valve member is formed with a specially shaped open window which occupies a selected sector of the valve member and whose size may vary with increasing distance from the rotary axis of the valve member and/or angular position on the member. Accordingly, when the valve member is rotated to position the window opposite the intake or exhaust passage, fluid is free to flow from the inlet end of that passage to the outlet end thereof. On the other hand, when the solid portion of the valve member intercepts the intake or exhaust passage, fluid cannot flow through that passage. Thus, rotation of the valve member, for example at crank shaft speed, periodically opens and closes the intake and exhaust passages alternately.

Further in accordance with the invention, the assembly includes means for varying the open time of the intake passage. More particularly, throttle means, e.g., a linear or rotary control member in the form of a throttle bar or throttle disk, are slidably mounted in the housing adjacent to the cavity containing the rotary valve member. The throttle means are movable parallel to the valve member toward and away from or around the rotary axis of that member. Furthermore, a through hole is provided in the throttle means which hole may be open to the intake passage at some or all positions of the throttle means.

Thus, the throttle means may be moved to a first position wherein the hole therein is located relative to the valve member window so that when that member is rotated to position the valve member window opposite the intake passage, the throttle means hole may be located opposite a relatively large area of the window. Therefore, steam will flow through the intake passage into the associated engine cylinder for a relatively long time. On the other hand, when the throttle means are moved to a second position, the hole therein may be located differently relative to the valve member window. Consequently, when the window in the valve member is rotated opposite the intake passage, the hole in the throttle means may lie opposite a smaller area of the window. Resultantly, less steam will flow to the engine cylinder. Intermediate settings of the throttle means may vary the open time of the intake passage between those two extremes. Thus, the amount of steam introduced into each engine cylinder during each cycle and so too engine speed and power will vary depending upon the position of the throttle means in each valve assembly.

Also, as will be described in detail later, the setting of the throttle means will also affect the phase angles at which the rotary valve member will open and close the intake passage (and perhaps also the exhaust passage) of the valve assembly.

In a reverse application, the valve assembly may operate in more or less the same way to control the fluid flow to and from the cylinder of a piston pump with the rotation of the valve member again being coordinated with the reciprocating or rotating action of the piston.

In a more general application, a valve assembly with a single passage and throttle means controlling fluid flow therethrough may be used in a variety of different situations to automatically regulate fluid flow so that it follows a selected flow profile over time.

BRIEF DESCRIPTION OF THE DRAWINGS

For a fuller understanding of the nature and objects of the invention, reference should be had to the following detailed description taken in connection with the accompanying drawings, in which.

DETAILED DESCRIPTION OF AN ILLUSTRATIVE EMBODIMENT

In the present application, we will describe our valve assembly used to convert a more or less conventional internal combustion engine so that that engine can operate under steam power. As noted above, however, our assembly also has application to control the flow of a working fluid generally so that the fluid has a selected profile over time.

Figure 1:
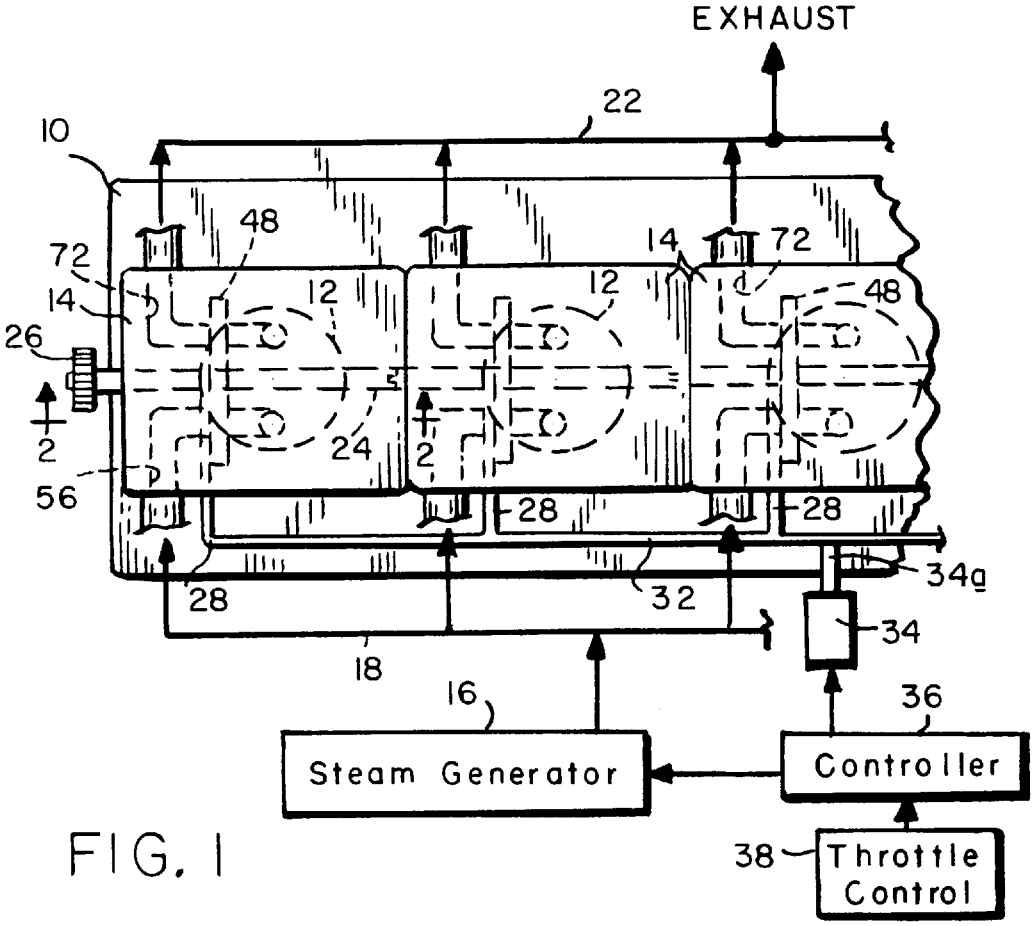
FIG. 1 is a fragmentary plan view with parts shown diagrammatically of a steam engine incorporating modular rotary discoid valve assemblies according to the invention.

Refer now to FIG. 1 of the drawings which shows an internal combustion engine 10 having cylinders 12. Only two such cylinders 12 are shown; a typical engine may have 4, 6, 8 or more such cylinders. The head of the engine 10 containing the usual reciprocating valves, valve lifters, etc., has been removed and replaced by modular rotary discoid valve assemblies 14 incorporating the invention. Two complete assemblies are illustrated in FIG. 1. Actually, the number of assemblies 14 will correspond with the number of cylinders in the particular engine.

High pressure steam from a steam generator 16 is supplied via an intake manifold 18 to each valve assembly 14. Each valve assembly 14 is designed to deliver that steam to the corresponding cylinder 12 during the intake portion of the cylinder cycle and to exhaust said steam from that cylinder during the exhaust portion of that cycle. That exhausting steam is vented to the atmosphere through an exhaust manifold 22 connected to each assembly 14.

Figure 10:
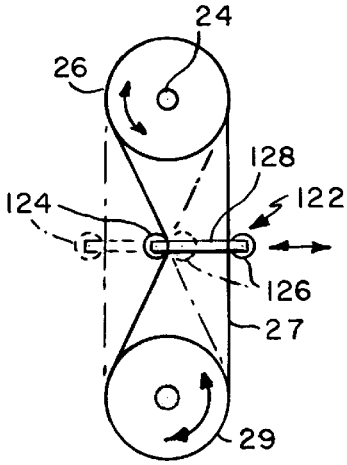
FIG. 10 is a diagrammatic view showing a phase controller for the illustrated valve assembles.

The operation of the valve assemblies 14 is coordinated with the operation of the engine and more particularly with the positions of the pistons 23 (FIG. 2) in the engine cylinders 12. For this, each assembly 14 includes a rotary shaft or axle 24. As best seen in FIGS. 1 and 10, a pulley 26 is mounted to the leading end of the shaft 24 in the first or leading assembly 14 on engine 10 and that pulley is connected via a suitable timing chain or belt 27 (FIG. 10) to the pulley 29 on the crank shaft of the engine 10. All of the assemblies 14 are mounted in a row on engine 10 such that the shaft of each assembly (except the first) is fixed to rotate with the shaft of the assembly in front of it. More particularly, in FIG. 1 the leading end of each of those shafts is keyed to the trailing end of the shaft of the assembly to the left of it so that when the pulley 26 is rotated, the shafts 24 of all of the assemblies 14 will rotate in unison.

In accordance with the invention, each assembly 14 also includes throttle means which may in the form of a throttle bar 28 for controlling the amount of steam entering the corresponding cylinder 12 during the intake portion of each engine cylinder. All of the throttle bars 28 are connected by a link 32 to the movable shaft 34*a* of a linear actuator 34. The actuator 34 is controlled by signals from a controller 36. Controller 36 responds to commands from a throttle control 38 which may, for example, include a pedal depressed by the engine operator's foot. Those commands cause controller 36 to operate actuator 34 to shift the throttle bar 28 so as to vary the opening and closing times of the valve assemblies 14 as will be described presently.

Figure 4:
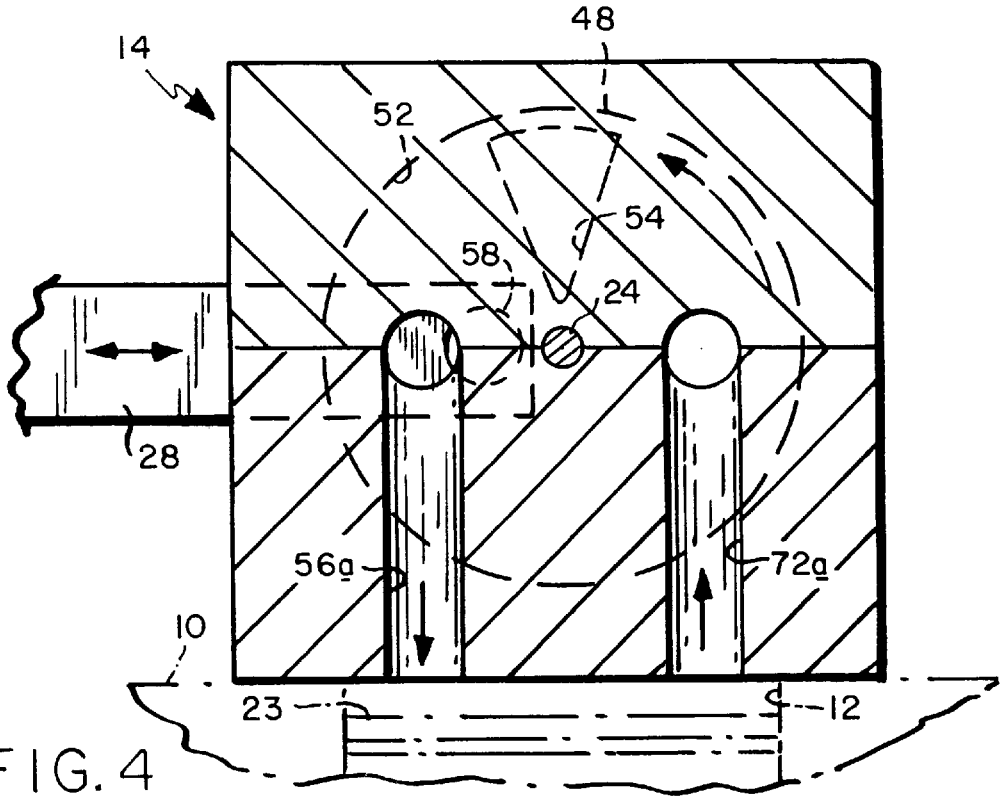
FIG. 4 is a sectional view taken along line 4—4 of FIG. 3.
Figure 2:
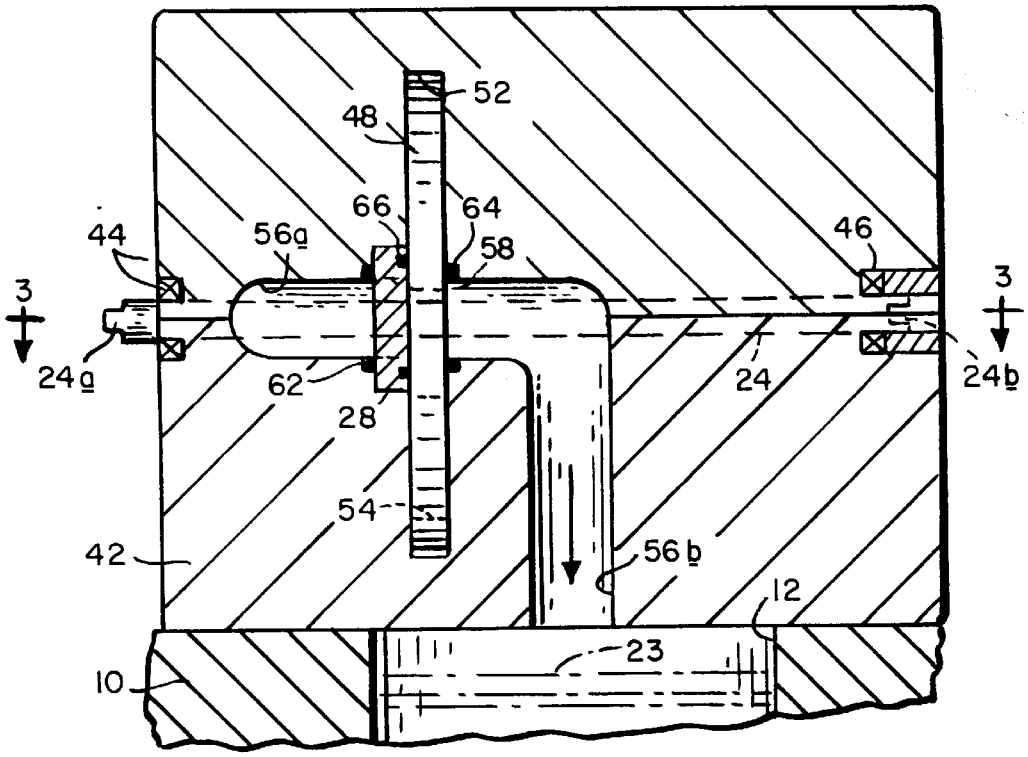
FIG. 2 is a sectional view on a larger scale taken along line 2—2 of FIG. 1.
Figure 3:
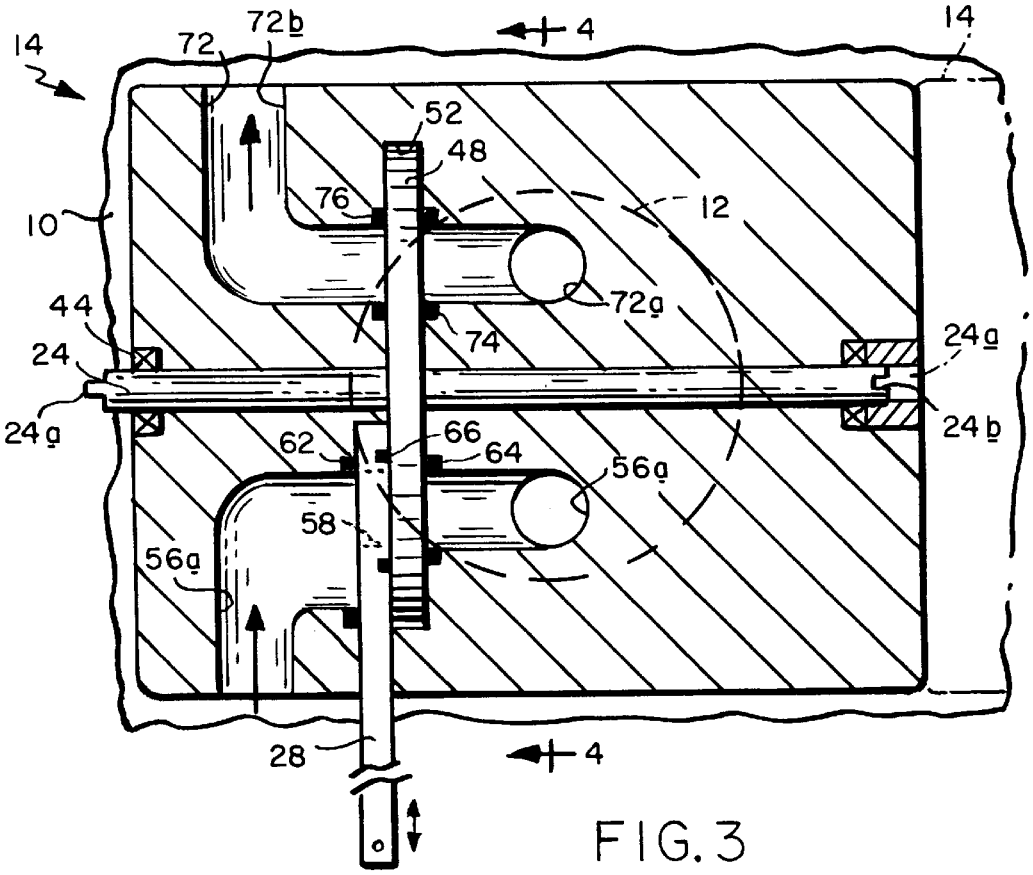
FIG. 3 is a sectional view taken along line 3—3 of FIG. 2.

Referring now to FIGS. 2 to 4 of the drawings, each module 14 comprises a block-like housing 42. A shaft 24 extends fore and aft within housing 42 and is rotatably supported in the housing by fore and aft bearing units 44 and 46. The leading end of shaft 24 projects from the housing and is terminated by a key 24*a*. The trailing end of shaft 24 is recessed into housing 42 and is formed with a slot 24*b*. Thus, when two assemblies 14 are positioned next to another as shown in FIG. 3, their shafts can be keyed together so that the shafts rotate in unison as described above.

The shaft 24 of each assembly 14 carries a valve member 48, preferably in the form of a plate or a disc, which rotates about its axis within a narrow cavity 52 in housing 42. As best seen in FIG. 4, valve member 48 is formed with a specially shaped open window 54 which occupies a selected sector of the valve member. While the specific window 54 is shown as being triangular, it may have some other shape which will allow the valve assembly to operate in the manner to be described. In general, the window has a size which varies with increasing distance from the valve member axis and/or angular position on that member.

Still referring to FIGS. 2 to 4, the valve assembly 14 includes an intake passage 56 which extends from the side of housing 42 facing intake manifold 18 (FIG. 1) to which it is connected down to the bottom of housing 42 where the passage opens into the cylinder 12 underlying that housing 42. The intake passage 56 includes an inlet side 56*a* on one side of disc 48, i.e., the left hand side in FIG. 3 and outlet side 56*b* on the opposite side of the disc. In other words, the two sides of passage 56 extend to the housing cavity 52 such that the passage 56 is intercepted by housing cavity 52 and the discoid valve member 48 therein.

Also, the throttle bar 28 is movably mounted in housing 42 between the inner end of the inlet passage section 56*a* and disc 48, the bar 28 facing the disc and being slidable in the housing radially along the disc. As shown in FIG. 3, a through hole 58 is provided adjacent the inner end of throttle bar 28 so that steam can flow from the intake passage section 56*a* to the valve member 48. More particularly, as the throttle bar is moved in and out, the incoming steam will be conducted to different radial areas of the discoid valve member 48. Thus, if the valve member 48 is rotated to position its window 54 opposite the intake passage 56, steam will be conducted from the intake passage section 56*a* through the hole 58 in the throttle bar 28 through the valve member window 54 to the intake passage section 56*b* and thence to cylinder 12. On the other hand, when the discoid valve member 48 is rotated to position a solid portion of the valve member opposite passage 56, no steam can flow to passage section 56*b* and thence to cylinder 12. As will be described in more detail later, depending upon the position of the throttle bar 28, the hole 58 in the throttle bar will overlap different portions of the window 54 in the valve member 48. This will effect the phase angles at which the intake passage 56 is opened and closed by the rotary valve member 48 and thus the open time of that passage.

As best seen in FIGS. 2 and 3, sliding seals 62 and 64 are provided at the inner ends of the passage sections 56*a* and 56*b*, respectively, to minimize steam leakage at those locations. A similar sliding seal 66 is provided around the throttle bar opening 58 to minimize leakage between the throttle bar and the valve member 48.

It is also important to note from FIG. 3 that the inner end of the passage section 56*a* is elongated in the sliding direction of the throttle bar 28 so that the inner end of intake passage section 56*a* will open into the hole 58 in the throttle bar at all positions of the throttle bar.

Still referring to FIGS. 2 to 4, the valve assembly also includes an exhaust passage 72 extending from the bottom of housing 42 facing cylinder 12 to the side of housing 42 facing the exhaust manifold 22 (FIG. 1). Passage 72 includes an inlet section 72*a* on one side, e.g., the right side, of valve member 48 and an outlet section 72*b* on the other, i.e., left, side of the valve member. The inner ends of both exhaust passage sections open into the housing cavity 52 such that the passage can be occluded by the rotary valve member 48. Preferably, sliding seals 74 and 76 are provided at the inner ends of those passage sections to minimize leakage at the boundaries between those passage sections and the rotary valve member 48.

Figure 5A:
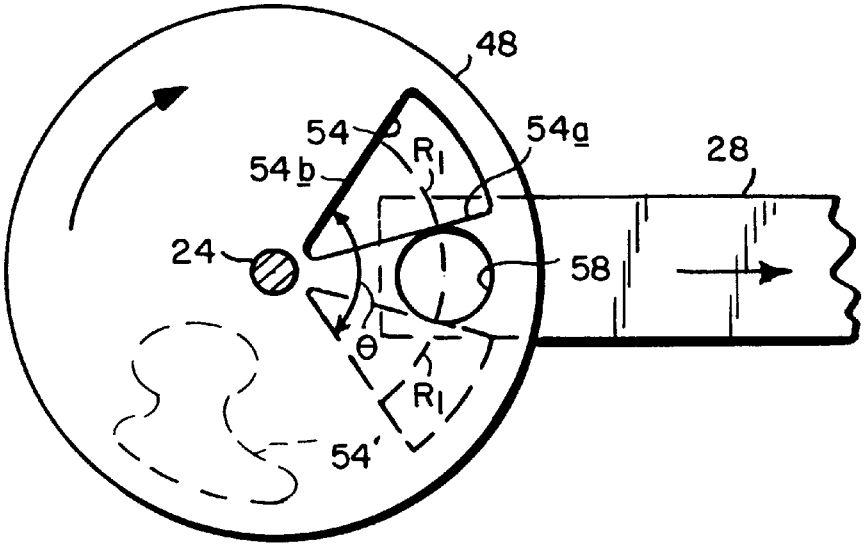
FIGS. 5A and 5B are diagrammatic views illustrating the operation of a valve assembly in FIG. 1.
Figure 5B:
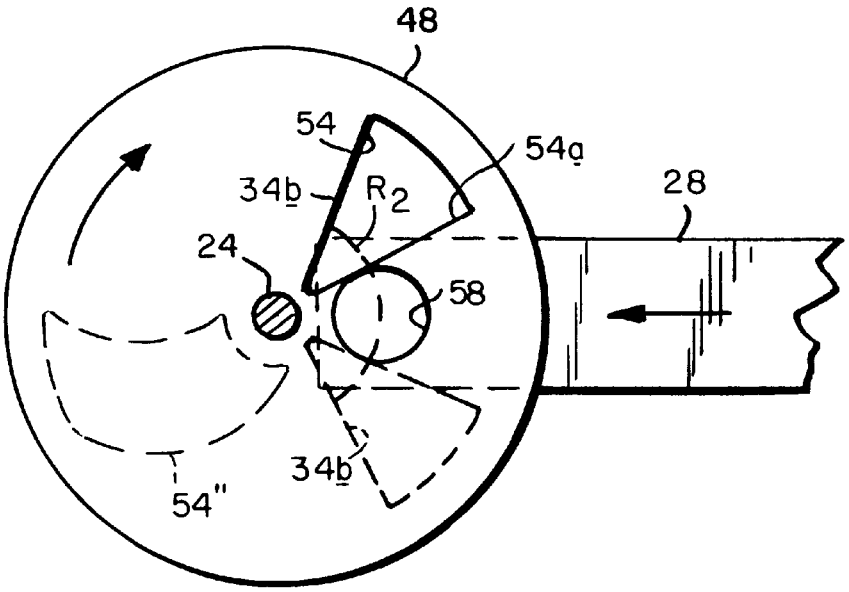

When the engine 10 is in operation, the valve member 48 of each valve assembly will rotate in the direction of the arrow in FIGS. 4, 5A and 5B in synchronism with the engine crank shaft which reciprocates all of the pistons 23 in cylinders 12. Resultantly, the window 54 in the valve member will be rotated alternately opposite the intake passage 56 and the exhaust passage 72 thereby alternately opening and closing those passages in a periodic manner so that high-pressure steam can flow into cylinder 12 when the piston in that cylinder is at top dead center and be exhausted from that cylinder when the piston is at or near the bottom of its stroke.

In accordance with the invention, the operator can control the speed and power of engine 10 by appropriately actuating the throttle control 38. Movement of the throttle control in one direction will cause controller 36 to control actuator 34 so that the actuator shaft 34*a* is advanced. Movement of the throttle control in the opposite direction will cause the actuator shaft 34*a* to retract. Those motions of the actuator shaft are transferred by linkage 32 to the throttle bar 28 of each valve assembly 14.

As best seen in FIG. 5A, when the throttle bar 28 of a valve assembly 14 is fully retracted, the hole 58 in the throttle bar 28 is located relatively far away from the axis of the discoid valve member 48, i.e., at a center distance $R_1$ where the window 54 is widest. Consequently, as the valve member 48 rotates in the direction of the arrow, the window 54 in the valve member will overlap the throttle bar opening 58 for a relative long period of time so that a relatively large volume of high-pressure steam can flow through the intake passage 56 to the cylinder 12 sufficient to drive the piston in that cylinder all the way to the bottom of its stroke. In other words, steam will begin to flow into the cylinder as soon as the leading edge 54*a* of the window 54 passes the upper edge of the throttle bar hole 58. The flow of steam will increase during the time the window 54 is directly opposite opening 58 and will decrease as the trailing edge 54*b* of the window approaches the lower edge of hole 58. Thus, at least some steam will flow to the cylinder while member 48 rotates through angle θ in FIG. 5A. During the rest of each revolution of member 48, the intake passage 56 will be occluded by the solid area of valve member 48 so that no steam can flow into cylinder 12.

On the other hand, when the throttle bar 28 is in its fully extended position, its hole 58 will lie relatively close to the axis of the valve member 48, i.e., at center distance $R_2$. Therefore, as the valve member 48 is rotated, the throttle bar hole 58 will overlap the narrower, radially inner end of window 54. Resultantly, steam will flow through the intake passage 56 to cylinder 12 for a relatively short period of time. As a consequence, the volume of steam introduced into cylinder 12 may only drive the piston 23 in that cylinder a relatively short distance toward the bottom of its stroke. Therefore, the cylinder will contribute minimum torque to the engine crank shaft which will thereupon operate at a relatively low speed and power. Of course, intermediate positions of the throttle bar 28 will result in intermediate volumes of steam being introduced into the cylinder 12.

As the setting of the throttle bar 28 affects the open time of the intake passage 56, it also affects the phase angle of the valving action in that passage. In other words, when the throttle bar 28 is in its fully retracted position in FIG. 5A, steam will flow through the intake passage to the cylinder sooner than is the case when the throttle bar is in its fully extended position as in FIG. 5B, thus affecting engine timing to some extent. This is advantageous because under certain load and rpm conditions, advancing or retarding the inlet and/or exhaust valves enhances efficiency, power or torque although not necessarily at the same time.

In a counterflow steam engine, shutting the exhaust valve early (i.e. before top dead center) may conserve energy by using what would be exhausted steam to pressurize the cylinder prior to opening the intake valve. Therefore, less additional steam is needed to create sufficient pressure to push the pistons down at the desired speed. Similarly, at high rpm, the intake valve remains open for a very short time. Opening the valve early (before TDC) allows the intake valve to stay open longer, permitting more steam to enter the cylinder, creating higher pressure.

Of course, during a later portion of the cylinder cycle when the intake passage 56 is occluded and the window 54 is positioned so that it overlaps the exhaust passage 72, the now low pressure steam in cylinder 12 will be vented to the atmosphere or a condenser via that passage for the duration of that overlap. Thus, steam will enter and leave the cylinder periodically with the amount of steam varying depending upon the setting of the throttle bar 28. The relative angular positions of the windows 54 on the valve member 48 in the various valve assemblies 14 may be the same or may be offset from one another to achieve optimum engine performance.

FIGS. 5A and 5B also illustrates the operation of our valve assembly as used to control fluid flowing periodically through a single passage intercepted by the rotary valve member 48, the amount of flow being controlled by throttle bar 28. Depending upon the particular application, the window 54 in valve member 48 may have a variety of different shapes as indicated by the free form window shown in phantom at 54' in FIG. 5A and/or its angular location on the valve member 48 may vary with increasing distance from shaft 24 as shown in phantom at 54" in FIG. 5B, or the window may have both of these characteristics. In some cases, the valve member may have more than one window; see 54 and 54' in FIG. 5A. In all cases, the objective is to achieve a selected flow profile through a flow passage over time. To facilitate reaching this objective, the movements of the valve member 48 and the throttle bar 28 may be coordinated by a suitably programmed controller similar to controller 36 in FIG. 1.

A valve assembly incorporating our invention may even be used as a controllable fluid mixing device. For example, the assembly may include two or more inlet conduits on one side of the rotary valve member, each equipped with a throttle bar and a corresponding number of outlet conduits on the opposite side of the valve member, with all of the outlet conduits leading to a single exit conduit. A different fluid may be introduced into each inlet conduit. As the valve member is rotated, the different fluids in the inlet conduits will be passed in turn through the window in the valve member to the outlet conduits and mixed in the exit conduit. The proportions of the different fluids in the final mix may be controlled by properly adjusting the various throttle bars in the assembly manually or automatically.

While we have specifically illustrated a valve assembly having a valve member 48 which rotates about an axis which extends fore and aft, e.g., parallel to the axis of the engine's crank shaft in FIG. 1, it should be understood that it is also possible to have member 48 rotate about an axis which is perpendicular to that axis such that in the mounted assembly, the disc lies in a generally horizontal plane thus giving the assembly a very low profile. In this event, the valve member 48 may be rotated by a fore and aft-extending shaft coupled by a bevel gear to the vertical valve member shaft or axle.

The above-described modular discoid valve member has only three main moving parts which are relatively easy to make in quantity. Both the rotary valve member 48 and the throttle bar 28 can be simple, stamped metal parts which are easy to assemble into the housing 42. The shaft 24 is also a standard part. Therefore, the cost of the assembly does not add appreciably to the overall cost of the engine 10. Moreover, because it is of such simple construction, the assembly should be able to operate for a prolonged period without maintenance.

Figure 6:
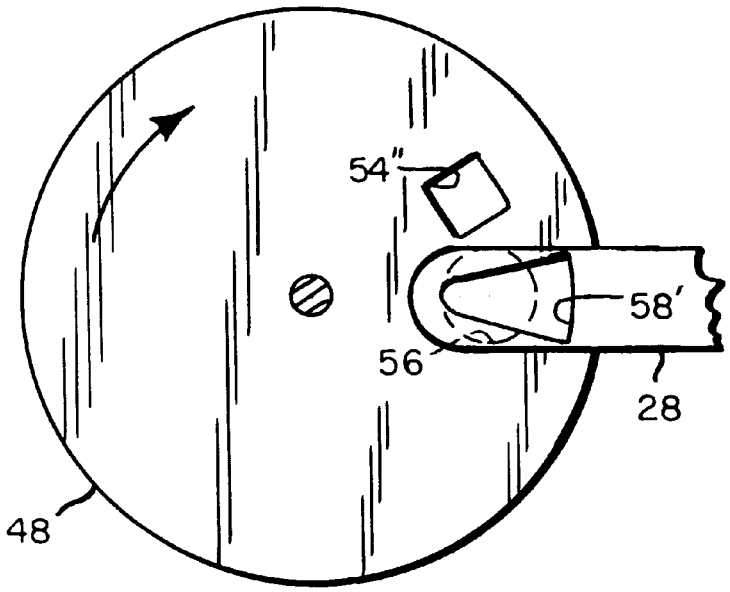
FIG. 6 is a diagrammatic view of another valve assembly embodiment.

Instead of the valve member 48 having a window whose size or shape varies relative to the rotary axis of the member as shown in FIGS. 4 and 5, the member may have a window which does not vary in those respects. Rather, the throttling effect may be achieved by having the hole in the throttle bar vary in width or shape depending upon the distance from the axis of the valve member 48. Such a valve assembly is depicted in FIG. 6. As seen there, the valve member 48 has a square window 54" and throttle bar 28 has a generally triangular hole 58'. Movement of the throttle bar 28 in and out will change the effective area of the opening into intake passage 56 when window 54" rotates opposite that passage.

Figure 7:
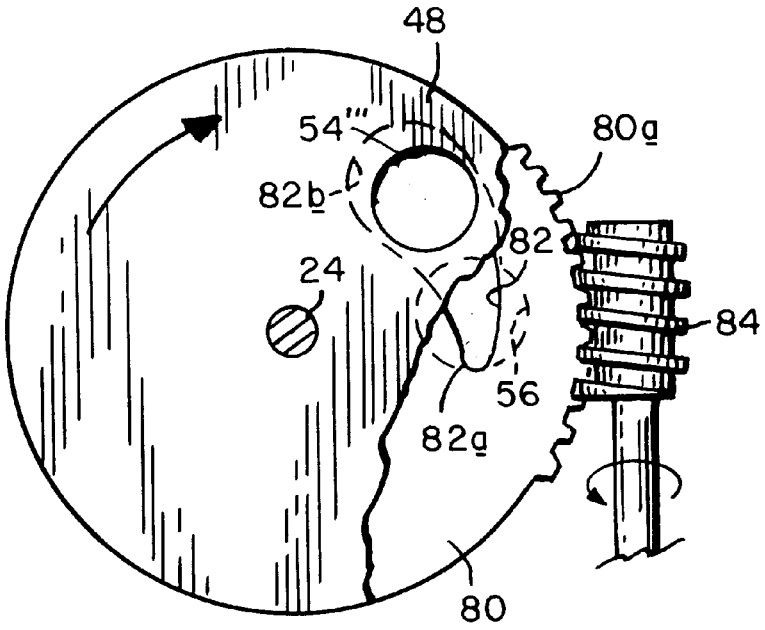
FIG. 7 is a view similar to FIG. 6 of still another embodiment of our valve assembly.

Instead of having a linear throttle means such as throttle bar 28, a rotary throttle means may be employed in the form of a throttle disc as illustrated in FIG. 7. In the valve assembly embodiment shown there, the valve member 48 has a circular window 54'" and a throttle disc 80 is positioned on shaft 24 flush against one side of valve member 48 within the housing cavity 52 as described above. Throttle disc 80 contains a hole 82 whose shape varies about the axis of the disc, the illustrated hole being wider at one end than the other. Disc 80 may be rotated relative to shaft 24 (and member 48) between a first angle which positions the narrow end 82*a* of hole 82 opposite the intake passage 56 and a second angle which positions the wider end 82*b* of hole 82 opposite passage 56. Thus, when the valve member 48 rotates to position its window 54'" opposite intake passage 56, different amounts of steam will pass through the window depending upon the angular position or phase of throttle disc 80.

Disc 80 may be moved between its two extreme positions by rotating a worm 84 which meshes with a gear track 80*a* at the periphery of disc 80.

Figure 8:
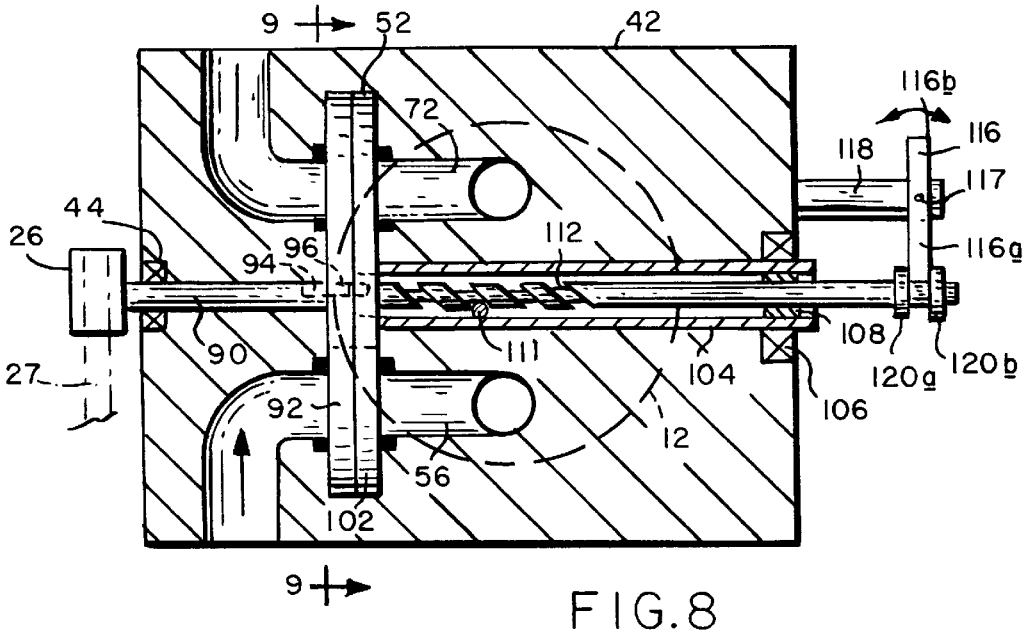
FIG. 8 is a view similar to FIG. 3 of a further valve assembly embodiment.
Figure 9:
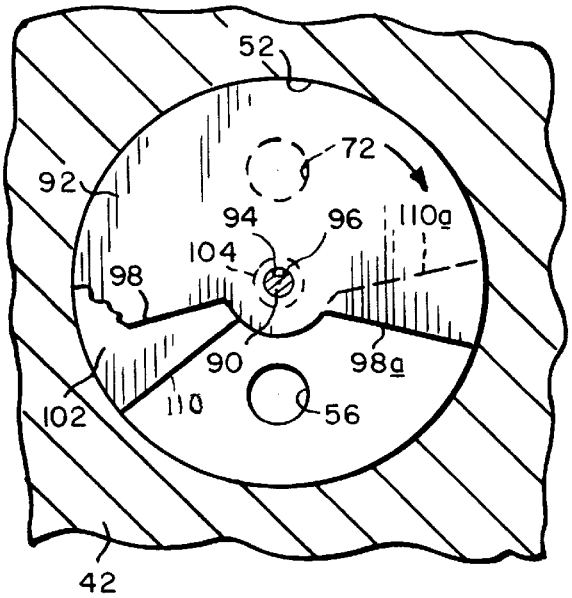
FIG. 9 is a sectional view taken along line 9—9 of FIG. 8.

Turn now to FIGS. 8 and 9 which illustrate yet another valve assembly embodiment. FIG. 8 is similar to FIG. 3 and similar parts carry the same numeric identifiers as in FIG. 3. This assembly embodiment has a shaft 90 rotatably mounted in housing 42. Fixed to rotate with shaft 90 within the housing cavity 52 is a rotary valve member 92. In this case, however, the shaft 90 is slidable within housing 42 relative to the valve member 92. For this, the shaft 90 contains a longitudinal keyway 94 which receives a key 96 extending radially inward from disc 92.

As best seen in FIG. 9, the valve member 92 has a window 98 which corresponds to a relatively large sector of the valve member. For example, the window may be 130 to 160 degrees and extend out to the periphery of the valve member. When the valve member 92 is rotated, the valve member periodically opens and closes the intake passage 56 and the exhaust passage 72 in succession.

This embodiment, like the one shown in FIG. 7, has a throttle means in the form of a rotary disc 102 positioned flush against the valve member 92 within the housing cavity 52. Disc 102 is fixed to rotate with a tubular shaft 104 which is coaxial to shaft 90 and rotatably mounted in housing 42. A bearing 106 is provided between the housing and shaft 104 to enable that shaft to rotate relative to the housing and a second bearing 108 is provided between shaft 104 and shaft 90 to allow shaft 104 to rotate relative to shaft 90.

The throttle disc 98 contains a hole 110 which replaces a relatively large, e.g., 130 to 160 degrees, sector of disc 102. In this, it is similar to the window 98 in the valve member 92. In fact, those two openings may have the same size and shape as shown in FIG. 9.

In accordance with the invention, the throttle disc 102 normally rotates with the valve member 92. However, provision is made for varying the angular position or phase of disc 102 relative to valve member 92. More particularly, the tubular shaft 104 is provided within an internal nub or boss 111 which is received in a helical groove 112 inscribed on shaft 90 opposite nub 111. As discussed above, shaft 90 is not only rotatable but slidable within housing 42. When shaft 90 is set at a selected axial position within the housing it fixes the position of nub 111 along groove 112 so that the shaft 104 is rotatably locked to shaft 90. Therefore, when shaft 90 is rotated, the valve member 92 and throttle disc 192 rotate in unison.

However, when shaft 90 is shifted axially, the engagement of nub 111 in groove 112 causes a change of angular position or phase of disc 102 relative to the throttle disc 92.

Referring to FIG. 8, shaft 90 may be shifted axially by means of a lever arm 116 connected by pivot 117 to a bracket 118 extending from the rear end of housing 42. One end 116*a* of lever arm 116 extends between a pair of collars 120*a* and 120*b* formed at the rear end of shaft 90. Movement of the opposite end 116*b* of the lever arm in one direction or the other causes an axial shift of shaft 90 in one direction or the other. Only a relatively small axial shift of shaft 90 is needed to change the phase angle of throttle disc 102 by a few degrees. To accommodate the axial shift of shaft 90, the pulley 26 at the front end of the shaft is made extra thick or deep so that it can shift axially without upsetting its connection to the timing chain 27.

When shaft 90 is rotated clockwise, the valve member 92 will periodically first open and then close intake passage 56 (and then exhaust passage 72). Shaft 90 may be positioned axially at one position so as to align the hole 110 in the throttle disc 102 with the window 98 in valve member 92. In that event, intake passage 56 (and exhaust passage 72) will remain open for a relatively long time during each revolution of the valve member. On the other hand, shaft 90 may be shifted to another position shown in FIG. 9 in which disc 102 is shifted angularly relative to valve member 92 (while still rotating therewith) so that the leading edge 110*a* of hole 110 lags the leading edge 98*a* of window 98. With this setting, intake passage 56 (and exhaust passage 72) is open for a shorter period of time during each revolution of the valve member. Also, the passage opens sooner in the cylinder cycle. In another setting of the throttle disc, its leading end 110*a* may lead the valve member edge 98*a* in which case the opening into passage 56 (and 72) may close sooner in the cylinder cycle. In other words, the valve member 92 opens and closes the steam flow through the intake passage 56 while the throttle disc 102 opens and closes entry into that passage either exactly with the valve member for long duration steam supply to cylinder 12 or ahead or behind the valve member for short duration steam supply to the cylinder. Intermediate supply durations are possible by shifting the throttle disc 102 over a typical phase angle range of, say, 30 degrees.

The valve member 92 and throttle disc 102 also open and close the exhaust passage 72 in the same way to control the steam exhaust from cylinder 12.

While the valve assemblies described above provide control of the intake and exhaust of steam from cylinder 12, in some applications it may be desirable also to adjust the phase of the valve assembly relative to the engine crank shaft to control engine timing. FIG. 10 illustrates a simple arrangement which allows for such timing control. As shown there, the timing chain 27 which couples the valve assembly pulley 26 to the crank shaft pulley 29 may be provided with a certain amount of slack. Such slack may be taken up by a dual idler mechanism shown generally at 122. This mechanism comprises a pair of idlers 124 and 126 connected by a bracket 128. The two idlers are arranged to engage opposite stretches of the timing chain 27 looped between pulleys 26 and 29. Suitable means (not shown) are provided for shifting mechanism 122 laterally in one direction or the other. When the mechanism is shifted to the right as shown in FIG. 10, idler 124 engages and deflects the left hand stretch of the timing chain thereby shifting pulley 26 slightly counterclockwise to change the phase angle of that pulley relative to pulley 29 and the crank shaft. Likewise, shifting mechanism 122 to the left in FIG. 10 causes the idler 126 to engage and deflect the right hand stretch of the timing chain while the pulley 124 is disengaged from the timing chain. This causes pulley 26 to be rotated clockwise through a small angle thereby changing its phase angle relative to pulley 29 in the opposite direction.

A steam engine or steam engine retrofit for an internal combustion engine incorporating one or another of the valve assemblies shown in FIGS. 1 to 9 and the timing adjustment mechanism illustrated in FIG. 10 allows one to control the operation of the associated engine over a wide range of engine operating conditions.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention described herein.

Having described our invention what is claimed as new and secured by Letters Patent is:

1. A rotary valve assembly comprising a fluid conduit;

a valve member having an open window;

means for rotatably mounting the valve member on an axis with respect to the conduit so that when the valve member is rotated about said axis, the plate occludes the conduit except when the window is opposite the conduit;

a control member having a through-hole therein;

means for rotatably mounting the control member on said axis so that it is in face-to-face contact with the valve member and rotatable with the valve member through an angle greater than 360°, and means for adjusting the phase of the control member relative to the valve member while both members are rotating, between a first angular position wherein the control member may or may not occlude at least part of the window when the valve member is rotated to position the window opposite the conduit and a second angular position wherein the valve member occludes a different part of the window when the valve member is rotated to position the window opposite the conduit.

2. The valve assembly defined in claim 1 wherein the control member is a flat plate.

3. The valve assembly defined in claim 1 wherein the valve member is a flat disc.

4. The valve assembly defined in claim 3 wherein said window lies within a selected sector of the disc.

5. The valve assembly defined in claim 1 wherein the control member is a circular plate and said hole lies within a selected sector of said plate.

6. The valve assembly defined in claim 1 wherein the size and/or angular position of the window varies within increasing distance from said axis.

7. The valve assembly defined in claim 1 wherein the valve member mounting means include a rotary first shaft, said first shaft also being movable axially;

said member is a circular plate fixed to rotate with the first shaft;

the control member mounting means include a tubular second shaft rotatably mounted coaxially to the first shaft for rotation therewith;

the control member is circular plate fixed to rotate with a second shaft, and the phase adjusting means include means for setting the angular relationship of said first and second shafts.

8. The valve assembly defined in claim 7 wherein the setting means include a helical groove extending along the first shaft;

a nub projecting radially inwardly from the second shaft and being engaged in the groove, and means for moving the first and second shaft relatively in the axial direction.

9. A rotary valve assembly comprising a housing having a plurality of walls including a bottom wall and another wall;

an intake passage in the housing, said passage having an outlet port at said bottom wall and an inlet port at another housing wall;

an exhaust passage having an inlet port at said bottom wall and an outlet port in another housing wall;

a cavity in the housing, said cavity intercepting the intake and exhaust passages;

a rotary valve member supported in said cavity for rotation about an axis, said member having an open window therethrough so positioned in the valve member that when the valve member is rotated to a first angular position, the window is located opposite the intake passage whereby a working fluid can flow from the inlet port of the intake passage through the window to the outlet port of the intake passage and when the member is rotated to a second angular position, the window is located opposite the exhaust passage so that the working fluid can flow from the inlet port of the exhaust passage through the window to the outlet port of the exhaust passage;

a control member having a through-hole;

means for rotatable mounting the control member on said axis so that it is in face-to-face contact with the valve member and rotatable with the valve member through an angle greater than 360°, and means for adjusting the phase of the control member relative to the valve member while both members are rotating, between a first position wherein the control member may or may not occlude at least part of the window when the valve member is rotated to position the window opposite the inlet port of the intake passage and a second angular position wherein the control member occludes a different part of the window when the valve member is rotated to position the window opposite the inlet port of the intake passage.

10. The valve assembly defined in claim 9 wherein the valve member is a flat disc.

11. The valve assembly defined in claim 10 wherein the size and/or angular position of said window varies with increasing distance from said axis.

12. The valve assembly defined in claim 9 wherein the window lies within a selected sector of said disc.

13. The valve assembly defined in claim 9 wherein the disc is supported by a shaft rotatably mounted in the housing and having opposite ends.

14. The valve assembly defined in claim 13 wherein the housing has front and rear walls, and the shaft extends between said front and rear walls.

15. The valve assembly defined in claim 14 wherein one end of the shaft projects from the housing and includes a key or keyway, and the opposite end of the shaft is recessed into the housing and includes a keyway or key.

16. The valve assembly defined in claim 15 and further including a second valve assembly similar to the first-mentioned valve assembly, said second valve assembly being positioned adjacent to the first-mentioned assembly so that said one end of the shaft in the second assembly is keyed to said opposite end of the shaft in the first mentioned assembly whereby the shafts of both assemblies may be rotated in unison.

17. The valve assembly defined in claim 16 and further including means for rotating said shafts;

means for introducing a working fluid into the intake passage of each valve assembly, and means for conducting the working fluid from the exhaust passage of each valve assembly to the atmosphere.

18. The valve assembly defined in claim 10 wherein the control member is a circular plate, and said hole occupies a selected section of said plate.

19. The valve assembly defined in claim 17 wherein the rotating means include a first pulley on said one end of the shaft of the first valve assembly;

a rotatably mounted crank shaft pulley;

a belt stretched around the first pulley and the crank shaft pulley to form a closed loop having first and second stretches extending between said pulleys so that the two pulleys rotate in unison, and means for deflecting either the first belt stretch or the second belt stretch laterally so as to change the phase angle of the first pulley relative to the crank shaft pulley.

* * * * *